US008181363B2

(12) United States Patent
Klein

(10) Patent No.: US 8,181,363 B2
(45) **Date of Patent: *May 22, 2012**

(54) MODULAR SHOE SYSTEM

(75) Inventor: Mark Klein, San Diego, CA (US)

(73) Assignee: Skins Footwear, Inc., Markham, Ontario (CA)

( * ) Notice: Subject to any disclaimer, the term of this patent is extended or adjusted under 35 U.S.C. 154(b) by 902 days.

This patent is subject to a terminal disclaimer.

(21) Appl. No.: 11/578,741

(22) PCT Filed: Oct. 7, 2004

(86) PCT No.: PCT/US2004/033446

§ 371 (c)(1),
(2), (4) Date: Jul. 30, 2007

(87) PCT Pub. No.: WO2005/034668

PCT Pub. Date: Apr. 21, 2005

(65) Prior Publication Data

US 2008/0134543 A1 Jun. 12, 2008

(51) Int. Cl.
*A43B 3/24* (2006.01)

(52) U.S. Cl. ..... 36/100; 36/101; 36/10

(58) Field of Classification Search ..... 36/101, 36/100, 10, 55

See application file for complete search history.

(56) References Cited

U.S. PATENT DOCUMENTS

| | | | | |
|---|---|---|---|---|
| 4,813,162 | A | 3/1989 | Harris | |
| 6,915,596 | B2 * | 7/2005 | Grove et al. | 36/100 |
| 7,010,872 | B2 * | 3/2006 | Pawlus et al. | 36/100 |
| 7,171,768 | B2 * | 2/2007 | Klein | 36/101 |
| 7,284,344 | B2 * | 10/2007 | Pawlus et al. | 36/100 |
| 7,444,763 | B2 * | 11/2008 | Grove et al. | 36/15 |
| 7,578,076 | B2 * | 8/2009 | Pawlus et al. | 36/100 |
| 2003/0097770 | A1 | 5/2003 | Karasawa | |
| 2004/0128863 | A1 * | 7/2004 | Hong et al. | 36/100 |

* cited by examiner

*Primary Examiner* — Ted Kavanaugh

(74) *Attorney, Agent, or Firm* — Mintz, Levin, Cohn, Ferris, Glovsky and Popeo, P.C.

(57) ABSTRACT

A modular shoe is provided by a two part shoe design. A first part is an internal support structure that includes a midsole portion and a heel counter. A second part is a removable cover that is configured to accept a specific size internal support structure to provide internal support to the soft material and outsole which comprise the cover. Various cover designs are configured to accept a single size internal support structure thereby providing for interchangeable cover and a plurality of shoe designs all sharing a single internal support structure. The removable cover takes substantially less packing space that supported shoe, thereby requiring reduced storage for a traveler packing several shoe designs all sharing a single internal support.

2 Claims, 13 Drawing Sheets

88

88
88

88

88

88

88

MODULAR SHOE SYSTEM

FIELD AND BACKGROUND OF THE INVENTION

The present invention relates to a modular shoe system and, in particular, it concerns a modular shoe having replaceable uppers and outsoles.

By way of introduction, a shoe typically includes a sole section and an upper section. The sole section includes an outsole or tread section, a midsole and an insole. The foot rests on the innersole and the outsole rests on the ground. The midsole is sandwiched between the innersole and the outsole. The uppers and outsole define the appearance of the shoe. There is a need for a modular shoe system having a midsole with replaceable uppers and outsoles due to a number of reasons. First, as fashions change there is a need to change the outside look of the shoe but not the midsole portion. Second, having a midsole with replaceable uppers and outsoles will reduce shoe production costs, reduce shoe storage in shops and at home in the closet.

Of relevance to the present invention is U.S. Pat. No. 1,803,554 to Knilans. Knilans teaches an athletic shoe having an elastic upper which may be inserted into or removed from a sole, heel counter and toe box. The toe box and heel counter portions are mechanically connected to the sole and cannot be changed. A shortcoming of the aforementioned system is that only part of the uppers are changeable. A further shortcoming of the aforementioned system is that the outsole cannot be changed. Another shortcoming of the aforementioned system is that the shape of the shoe cannot be changed.

Also of relevance to the present invention is U.S. Pat. No. 5,065,531 to Prestridge. Prestridge teaches a shoe having an upper portion and a sole-and-toe portion which are releasably joined together by a male/female track attachment. The upper portion includes the rear section of the uppers and the eyelets therein. A shortcoming of the aforementioned system is due to the tread being connected to the innersole and is not independently changeable. A further shortcoming of the aforementioned system is that only part of the uppers are changeable. Another shortcoming of the aforementioned system is that the shape of the shoes cannot be changed.

Of most relevance to the present invention is U.S. Pat. No. 5,822,888 to Terry. Terry teaches a reversible shoe having a removable midsole. The uppers are permanently joined to the outsole forming one piece. A shortcoming of the aforementioned system is due to the uppers having a zip or similar arrangement to hold the uppers in place on the midsole. The zip is visible, at least partially, and is prone to breaking. Another shortcoming of the aforementioned system is that the toe-cap is formed with the midsole and is not replaceable. A further shortcoming of the aforementioned system is that the uppers are not completely replaceable. Another shortcoming of the aforementioned system is that the shape of the shoe is restricted to the shape of the midsole structure.

Also of relevance to the present invention is U.S. Pat. No. 6,427,363 to Hunter. Hunter teaches a reversible shoe that can be taken apart and reassembled. The uppers are permanently joined to the tread forming one piece. The shoe is assembled using laces, snaps or buttons. An innersole is preferred but not essential. A shortcoming of the aforementioned system is due to the uppers having a laces, snaps or buttons to hold the uppers and tread together. The laces, snaps or buttons are visible and do not allow for convenient assembly and de-assembly of the shoe.

Therefore, there is a need for a modular shoe system having conveniently wholly replaceable uppers and outsoles without the need for additional fasteners in the uppers.

SUMMARY OF THE INVENTION

The present invention is a modular shoe system construction and method of operation thereof. In brief, the invention provides a shoe construction whereby an outer shell is replaceable to provide for multiple shoe constructions employing a single inner support element. A shoe of the invention consists of two main components. A core (hereinafter "bone") serves as an internal support structure and as a salubrious vesting of the foot by acting as an orthopedic insole. A cover (hereinafter "skin") envelops the bone to creating the illusion of a regular shoe-upper and outsole. The interchangeable skin determines the type, look, and style of the shoe. In an alternate construction, the bone includes of a specially studied sanitized insole.

BRIEF DESCRIPTION OF THE DRAWINGS

The invention is herein described, by way of example only, with reference to the accompanying drawings, wherein.

DETAILED DESCRIPTION

The present invention is a modular shoe system construction and method of operation thereof. The principles and operation of a modular shoe system according to the present invention may be better understood with reference to the drawings and the accompanying description.

Figure 1A:
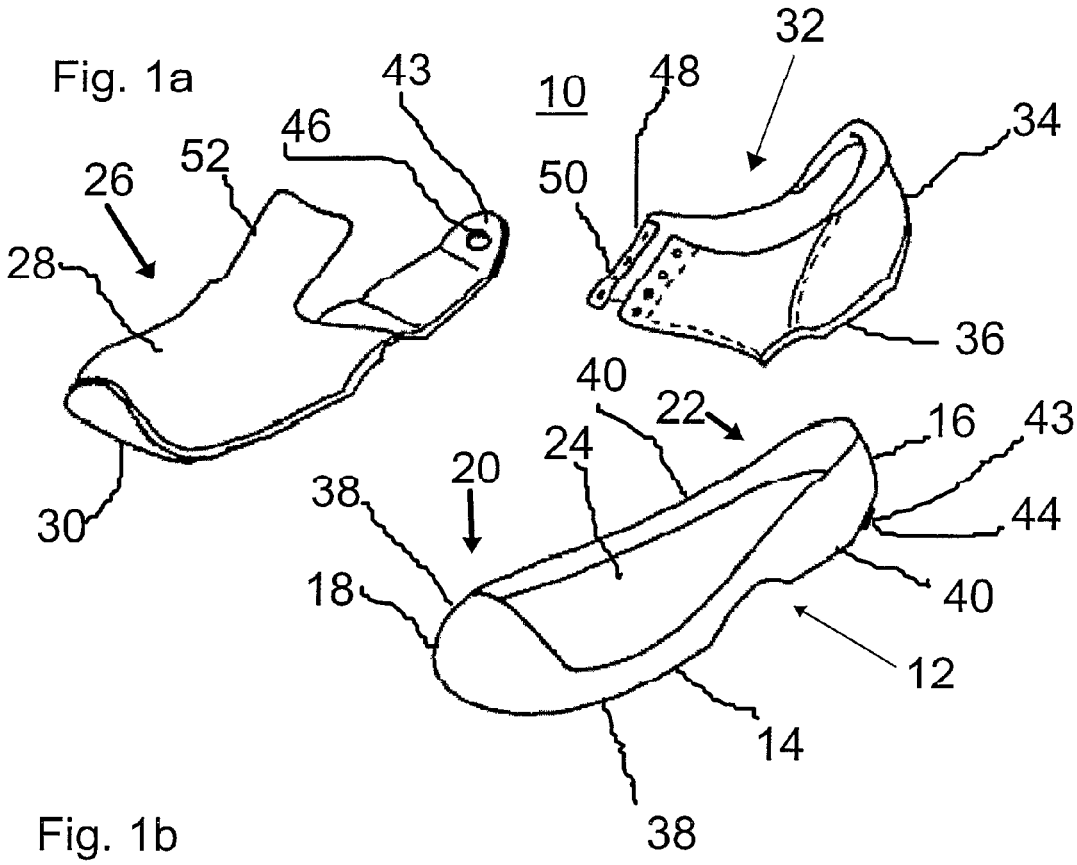
FIG. 1*a* is an isometric view of a modular shoe system that is constructed and operable in accordance with a preferred embodiment of the present invention.
Figure 1B:
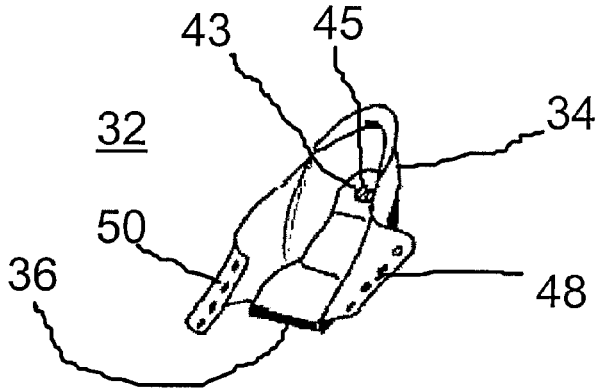
FIG. 1*b* is an isometric view of a rear removable cover of the modular shoe system of FIG. 1*a;*
Figure 1C:
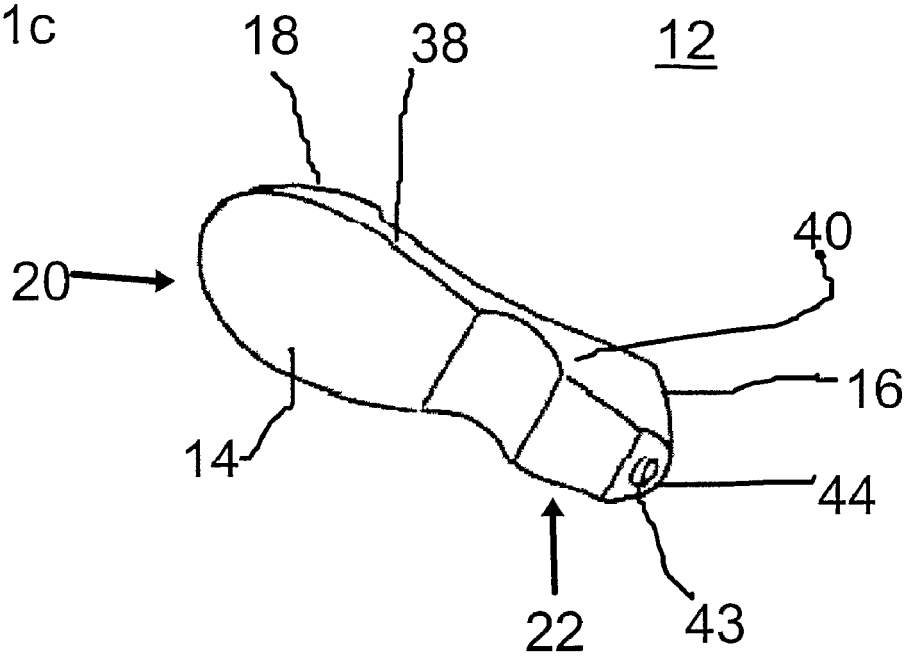
FIG. 1*c* is an isometric view of the base of an internal support structure of the modular shoe system of FIG. 1*a;*
Figure 1D:
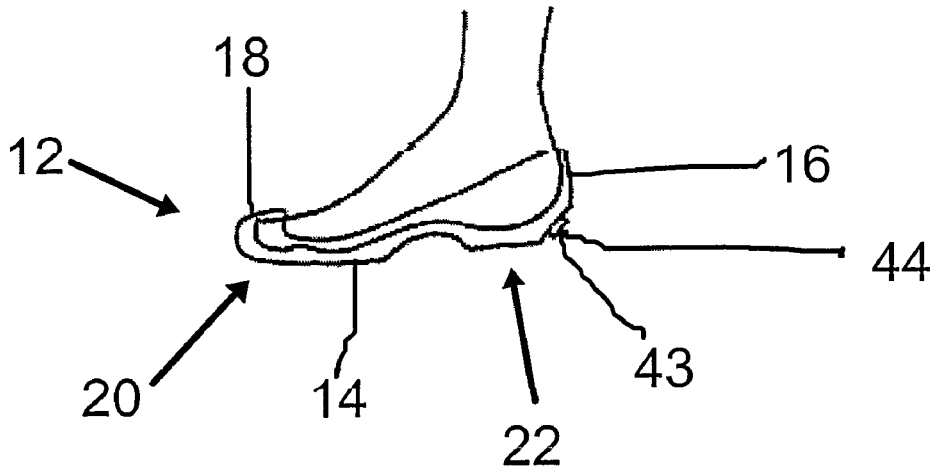
FIG. 1*d* is a cross-sectional view of the internal support structure of FIG. 1*c* being fitted to a foot.
Figure 1E:
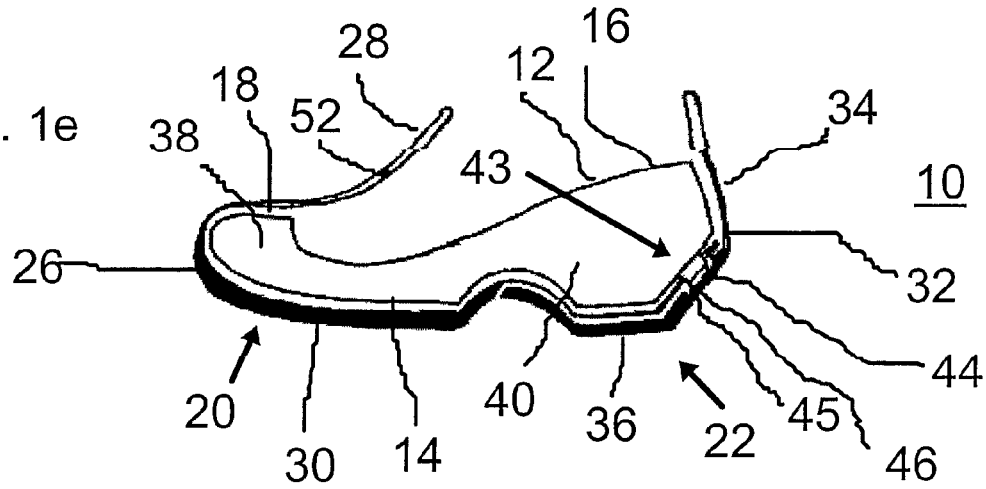
FIG. 1*e* is a sectional view of the modular shoe system of FIG. 1*a* in an assembled state.
Figure 1F:
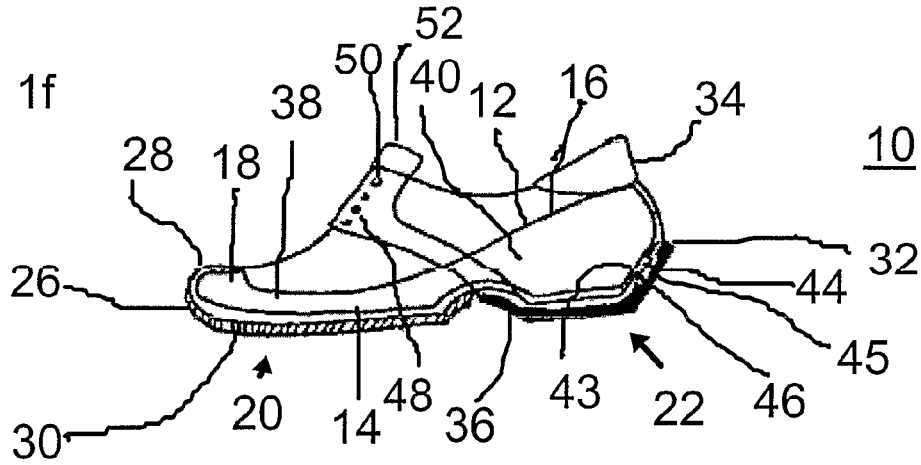
FIG. 1*f* is a schematic view of the modular shoe system of FIG. 1*a* in an 10 assembled state.
Figure 1G:
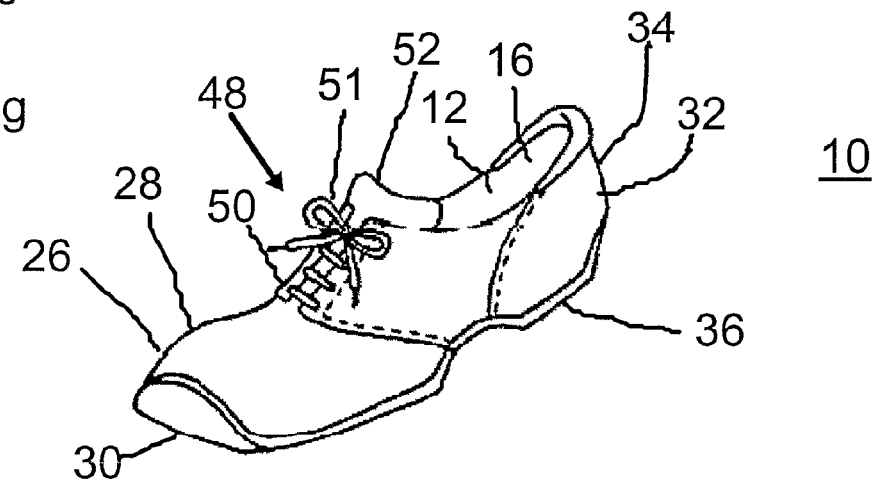
FIG. 1*g* is an isometric view of the modular show system of FIG. 1*a* in an assembled state.

Reference is now made to FIGS. 1*a* to 1*g*. FIG. 1*a* is an isometric view of a modular shoe system 10 that is constructed and operable in accordance with a preferred embodiment of the invention. FIG. 1*b* is an isometric view of a rear removable cover 32 of modular shoe system 10. FIG. 1*c* is an isometric view of the base of an internal support structure 12 of modular shoe system 10. FIG. 1*d* is a cross-sectional view of internal support structure 12 being fitted to a foot. FIG. 1*e* is a sectional view of modular shoe system 10 in an assembled state. FIG. 1*f* is a schematic view of modular shoe system 10 in an assembled state (for the sake of clarity and presentation, certain features which would otherwise be hidden are shown making other features semi-transparent). FIG. 1*g* is an isometric view of modular shoe system 10 in an assembled state. Modular shoe system 10 includes internal support structure 12. Internal support structure 12 includes a midsole 14, a heel counter 16 and a toe box 18. Internal support structure 12 has a front portion 20 which includes toe box 18. Internal support structure 12 has a rear portion 22 which includes heel counter 16. Internal support structure 12 also includes an insole 24 disposed therein (FIG. 1*a*). In one embodiment the Internal support structure is formed with injected polyurethane with sanitized comfort lining made of leather, textiles, or man-mades fabric. In other embodiments, the Internal support structure 12 is formed with other materials such as leather, a synthetic compound, thermoplastic, rubber, latex, wood, or cork.

The internal support structure 12 preferably includes a heel area, an arc area, and a toe area. The heel area incorporates a heel counter 16 which helps support and hold the wearer's ankle in place so as to limit shoe slipping or other unnecessary movement. In one embodiment, the heel includes an inbuilt shock absorbent. In one embodiment, the arc area is orthopedic shaped and is designed to support a wide variety of foot arc shapes. In one embodiment, the toe area includes a carefully studied toe-spring angle. The toe area also incorporates a toe-cap which retains and protects the toes.

Modular shoe system 10 includes a plurality of interchangeable first removable covers, for example, a removable cover 26. Other examples of suitable first removable covers are described with reference to FIGS. 4 to 7*v*. Each of the first removable covers is configured for being alternately removably attached to the internal support structure 12 by a self aligning pressure mechanism. When modular shoe system 10 is assembled, removable cover 26 substantially covers the internal support structure 12 since the removable cover and internal support structure are made to a particular size to provide for accurate alignment between the longitudinal axis of each. Hence, removable cover 26 is removably attached to internal support structure 12 substantially solely by pressure exerted internal support structure 12 on removable cover 26. The heal counter 16 serves to support the rear of the cover 26 in an upright position, thus providing a comfortable heal portion in the assembled shoe system 10. The term "attached substantially solely by pressure" is defined herein as, the pressure exerted by internal support structure 12 on removable cover 26 is sufficient to ensure that removable cover 26 remains attached to internal support structure 12 during normal use of modular shoe system 10 even though, for example, other connection means between removable cover 26 and another element of modular shoe system 10 may make the attachment between removable cover 26 and internal support structure 12 more secure.

Figure 3:
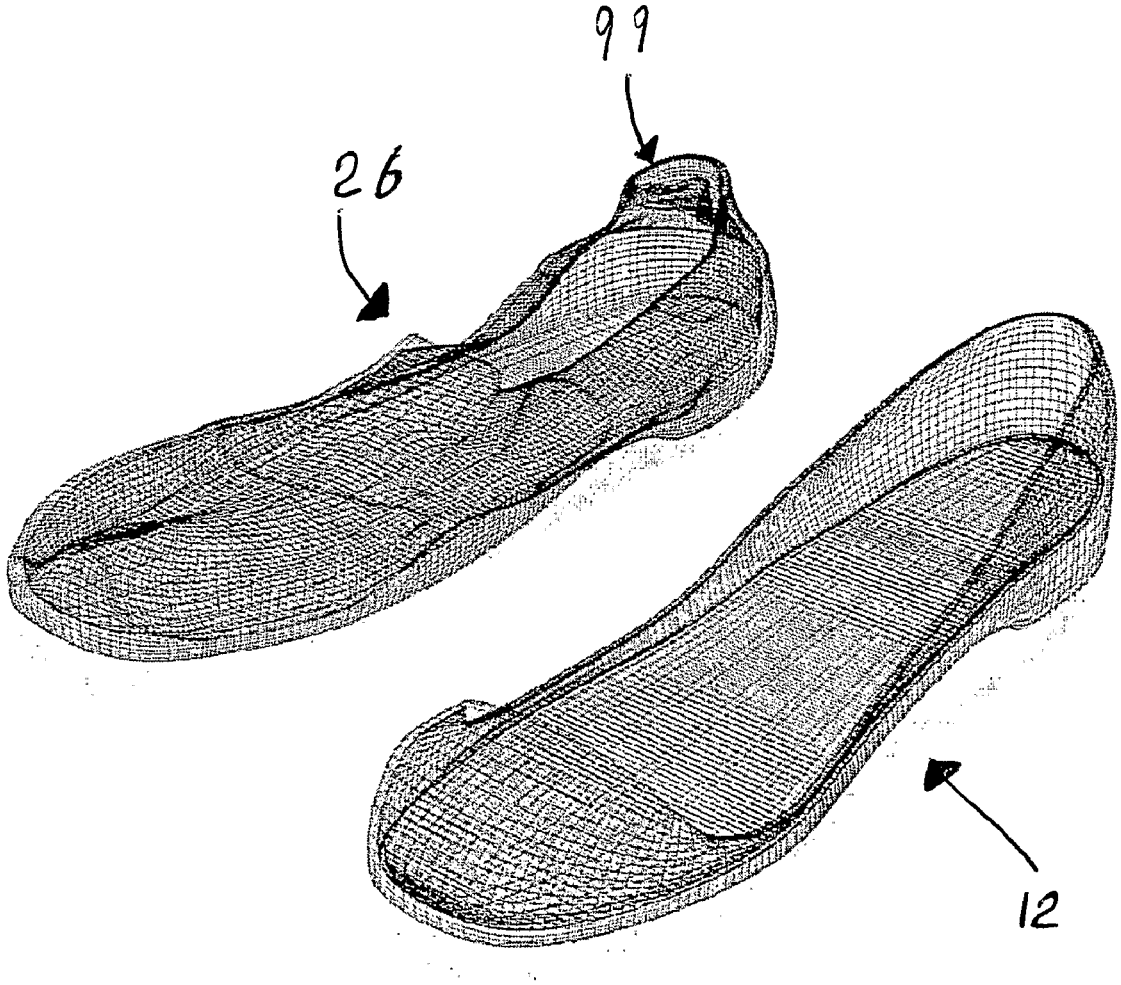
FIG. 3 is an isometric view of the two components of an internal support structure and a removable cover including a heel flap.
Figure 4:
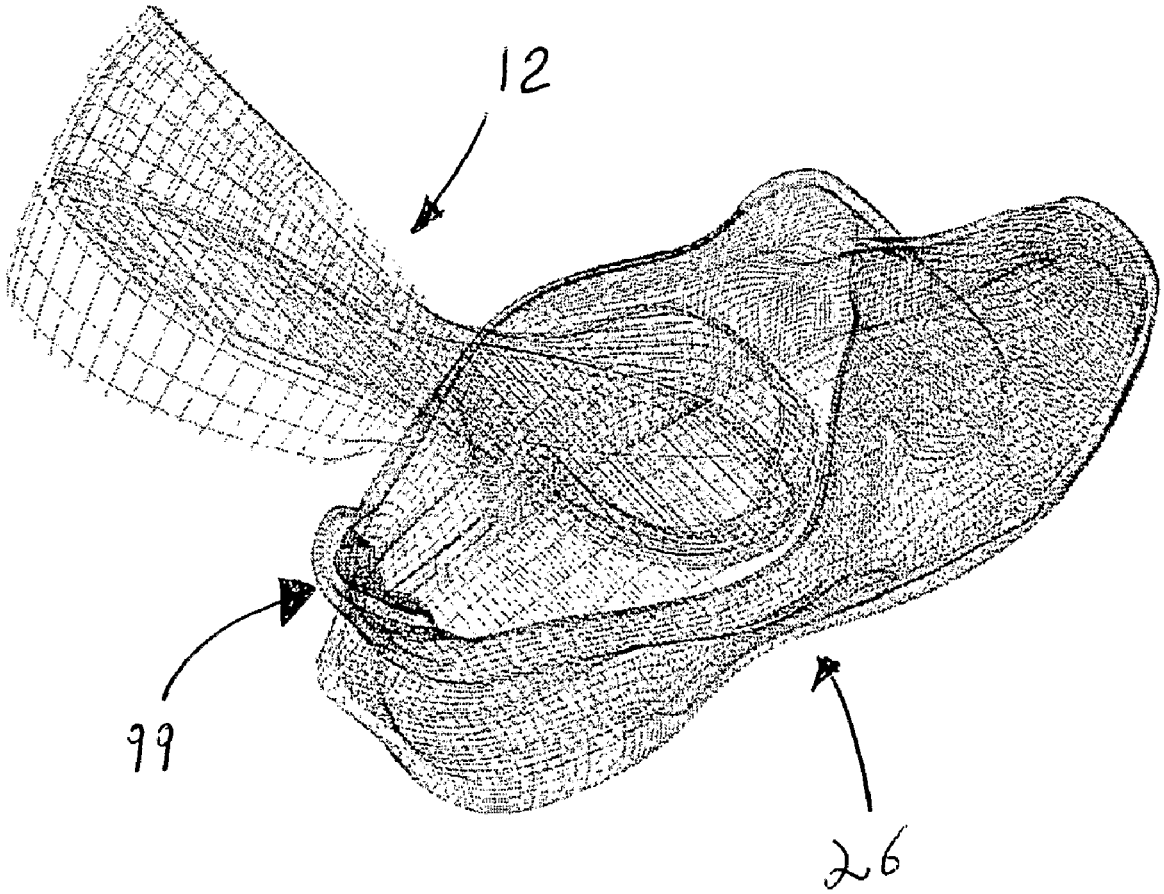
FIG. 4 illustrates the internal support structure being inserted into the removable cover.
Figure 6:
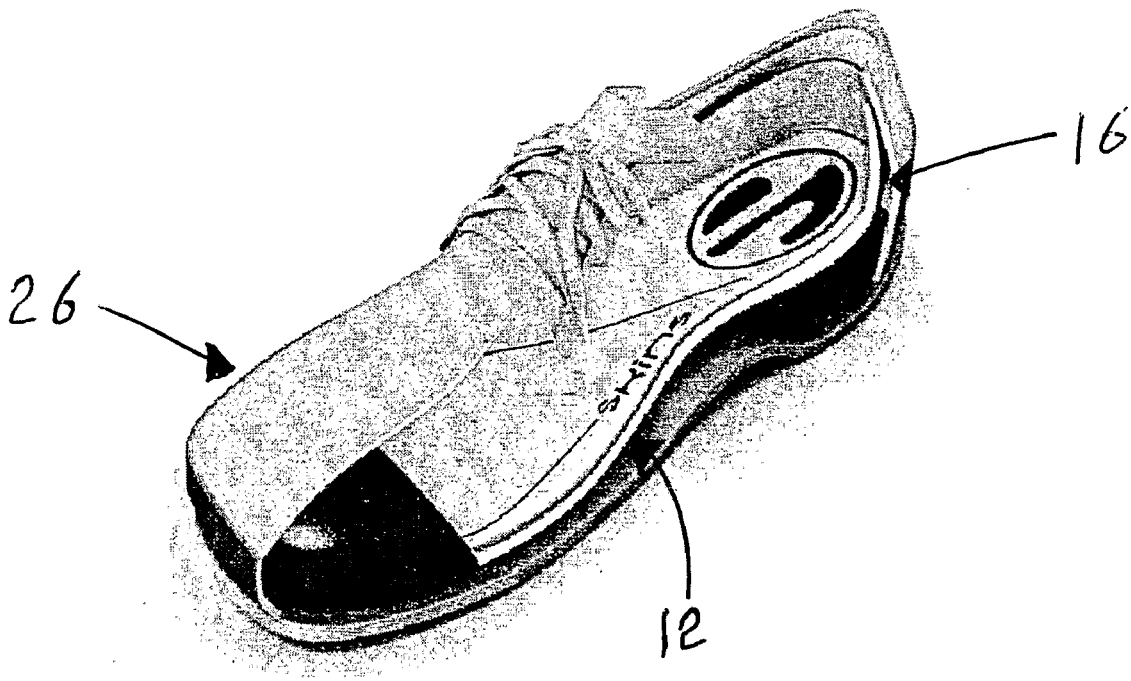
FIG. 6 illustrates cutout plane and isometric views of a modular shoe of the invention.

To ensure that the heal counter 16 remains in position to properly apply pressure to the heal portion of the cover 26 and assist in alignment between the cover and internal support structure 12, as shown in FIGS. 3, 4, and 6, an internal flap 99 is provided to substantially cover the top of heal counter 16. In particular, heel counter 16 and edges 40 of midsole 14 exert pressure on removable cover 32 to ensure that removable cover 32 is securely attached to internal support structure 12 and is properly aligned therewith.

Removable cover 32 also includes a fastening arrangement 48 configured for securing modular shoe system 10 to a foot of a wearer. In accordance with the preferred embodiment of the present invention, fastening arrangement 48 includes a plurality of eyelets 50 configured for inserting a shoelace 51 through eyelets 50 (FIG. 1*g*). In accordance with an embodiment of the present invention, removable cover 26 includes a tongue 52 configured for being disposed at least partially beneath fastening arrangement 48.

Figure 2:
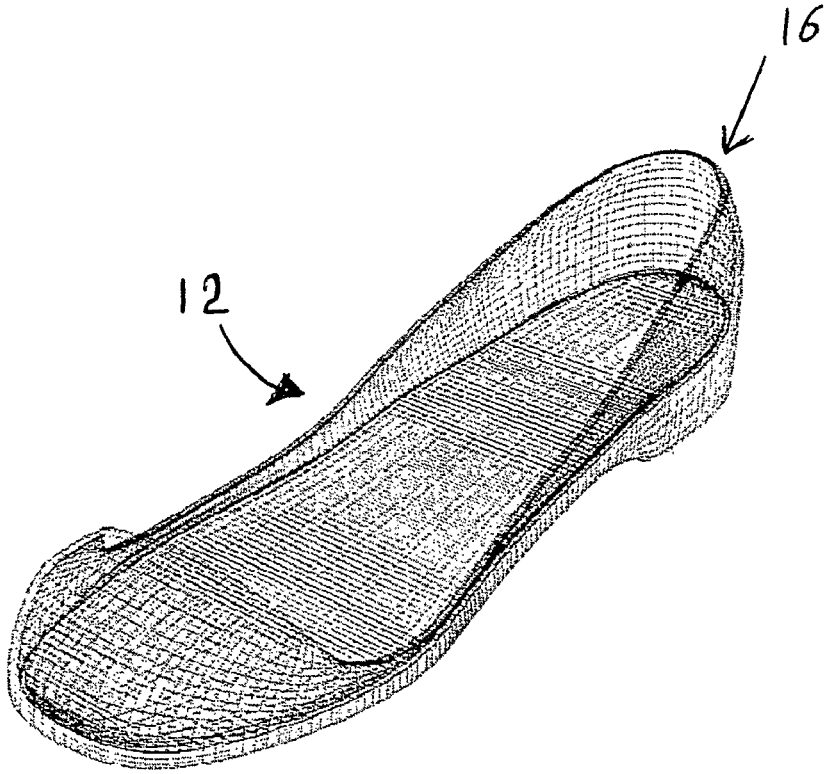
FIG. 2 is an isometric view of an alternative embodiment of an internal support structure of the invention.

FIG. 2 illustrates an embodiment of the internal support structure of the invention. The internal support structure of FIG. 2 includes a shaped heel counter and a rounded toe cap. FIG. 3 illustrates a cover 32 and an internal support structure of the embodiment of FIG. 2. FIG. 4 illustrates the same internal support and cover when the internal support is inserted into the cover to provide a modular shoe of the invention.

Figure 5:
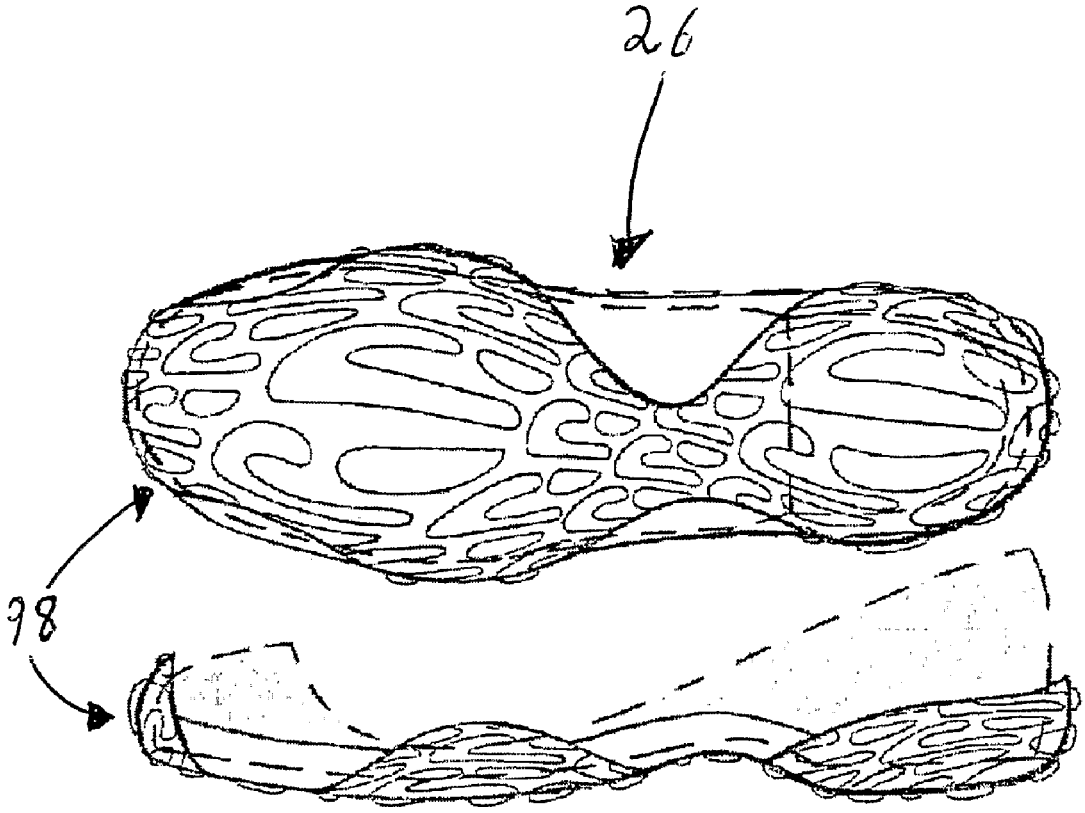
FIG. 5 illustrates plane views for a removable cover of the invention having a molded outsole.

FIG. 5 illustrates an exemplary outsole design for a cover of the invention. As may be appreciated the outsole 98 may be formed with threads to provide increased traction for the resultant modular shoe.

FIG. 6 illustrates three cutout views of a modular shoe of the invention after the internal support structure has been inserted and aligned with the cover.

Figures 7A, 7B, 7C, 7D, 7E, 7F, 7G:
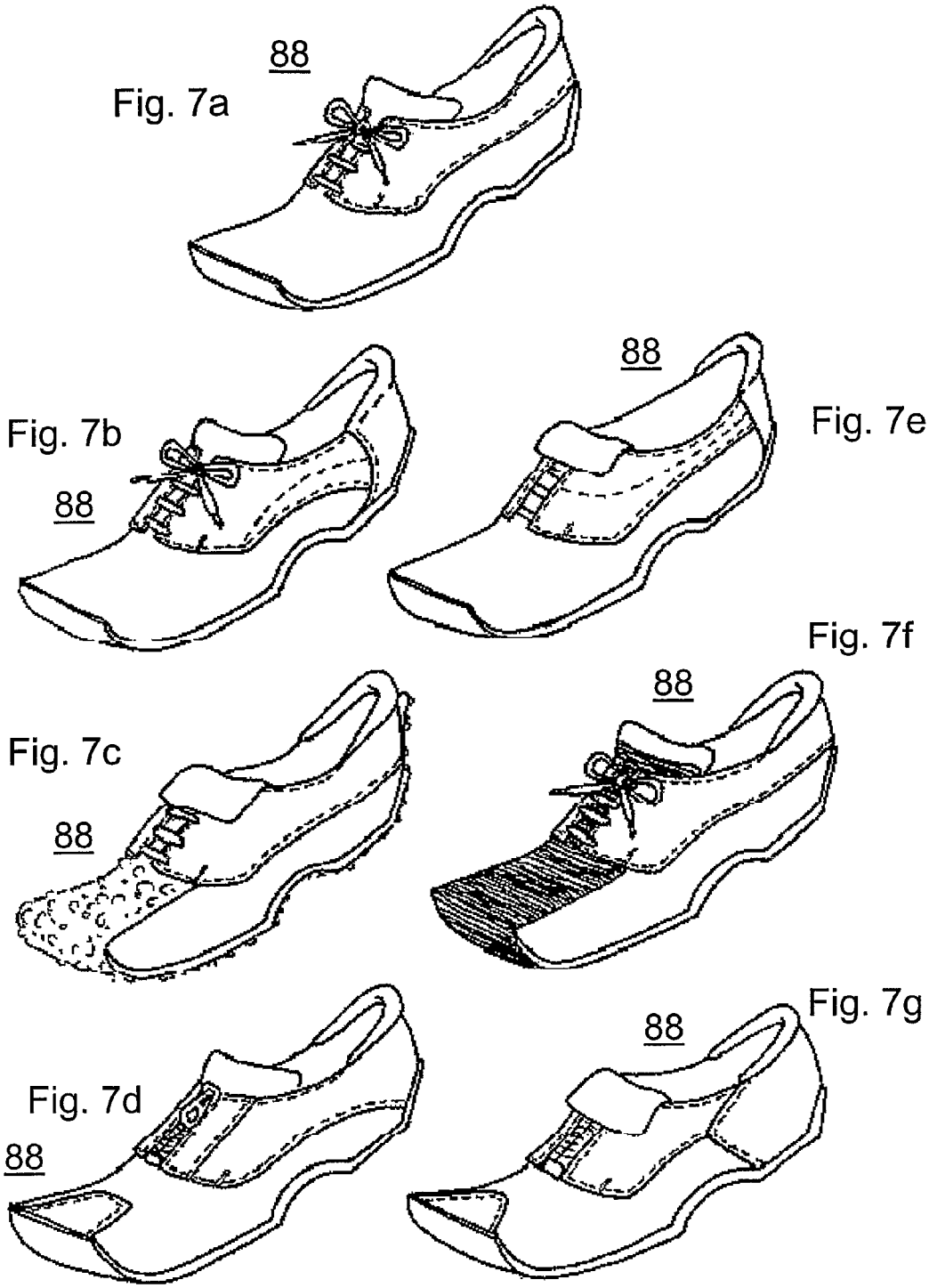
FIGS. 7*a* to 7*v* are isometric views of removable shoe covers attached to the internal support structure of FIG. 1 *c*.
Figure 7H:
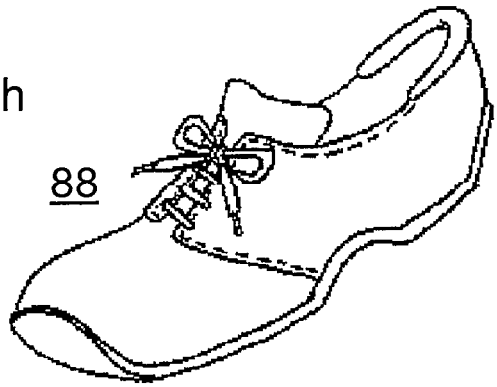
Figure 7I:
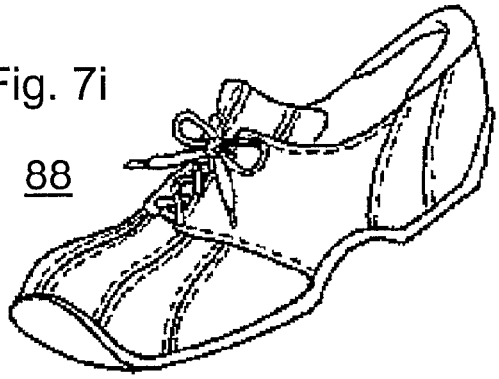
Figure 7L:
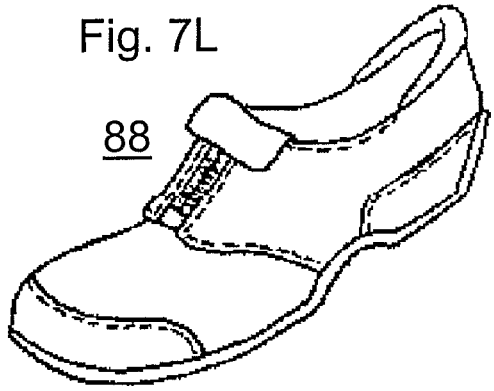
Figure 7J:
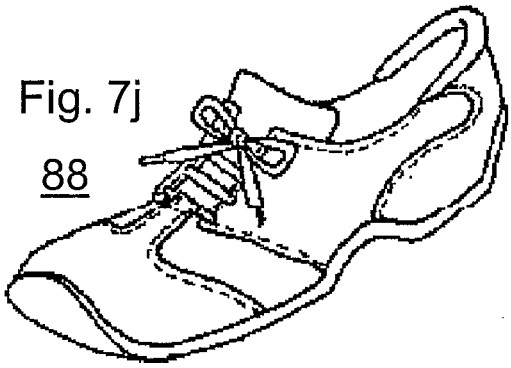
Figure 7M:
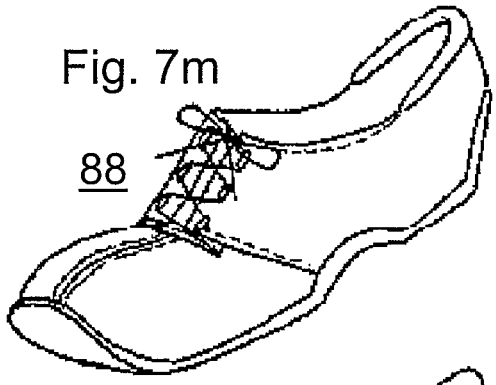
Figure 7K:
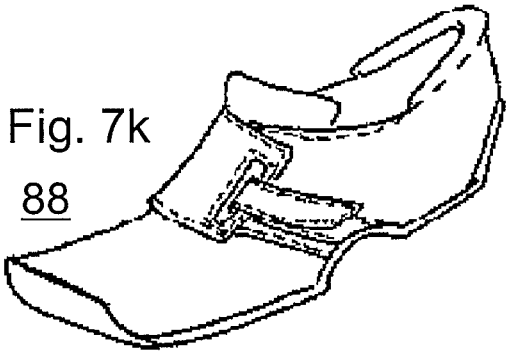
Figure 7N:
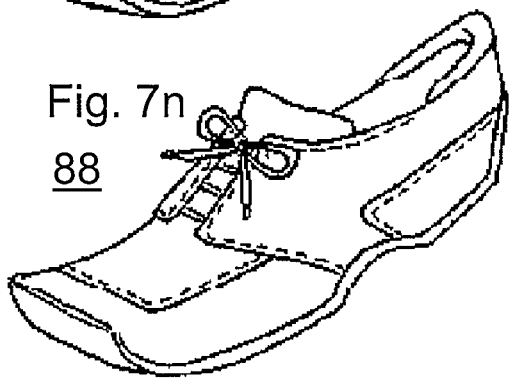
Figure 7O:
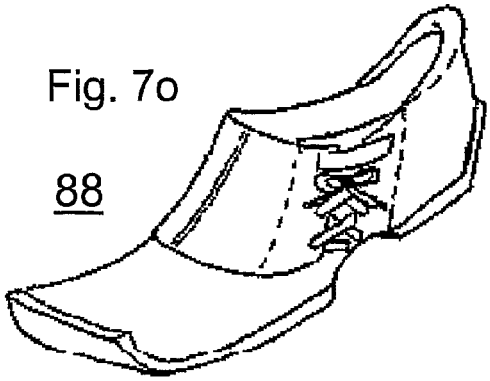
Figure 7S:
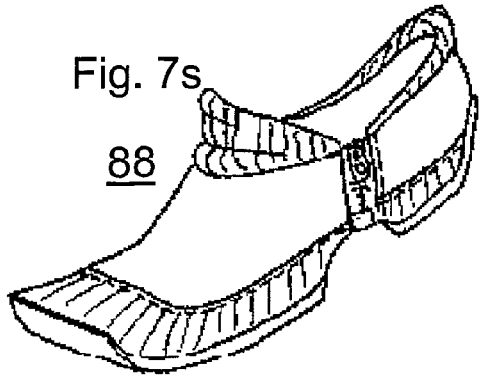
Figure 7P:
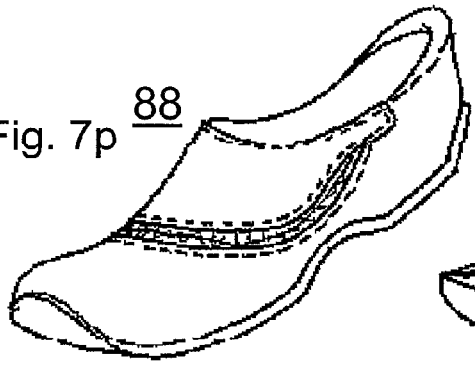
Figure 7T:
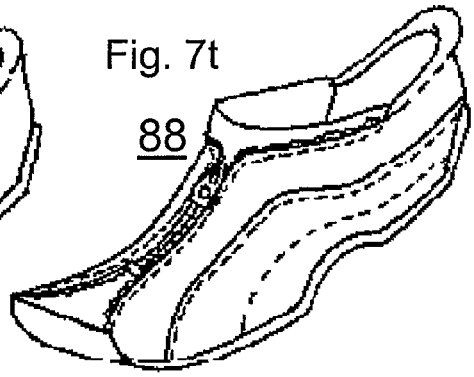
Figure 7Q:
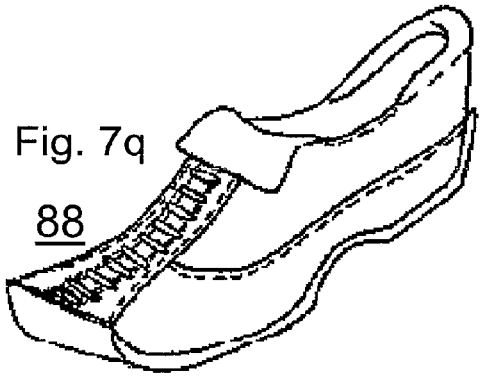
Figure 7U:
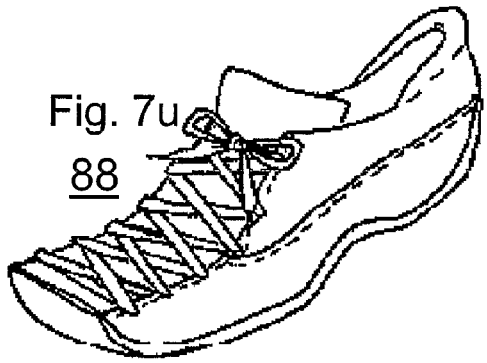
Figure 7R:
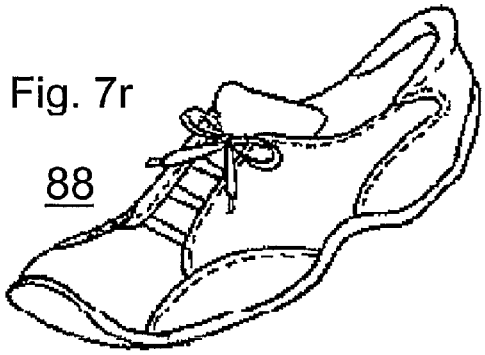
Figure 7V:
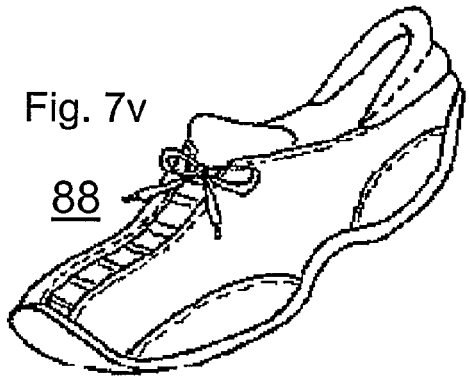

Reference is now made to FIGS. 7*a* to 7*v*, which are isometric views of removable shoe covers 88 alternately attached to internal support structure 12 of FIG. 1*c*. It will be appreciated by those ordinarily skilled in the art that the teachings of the modular shoe system of the present invention can be applied to form shoes of most shapes and designs including shapes and designs of both uppers and outsoles.

Figure 8A:
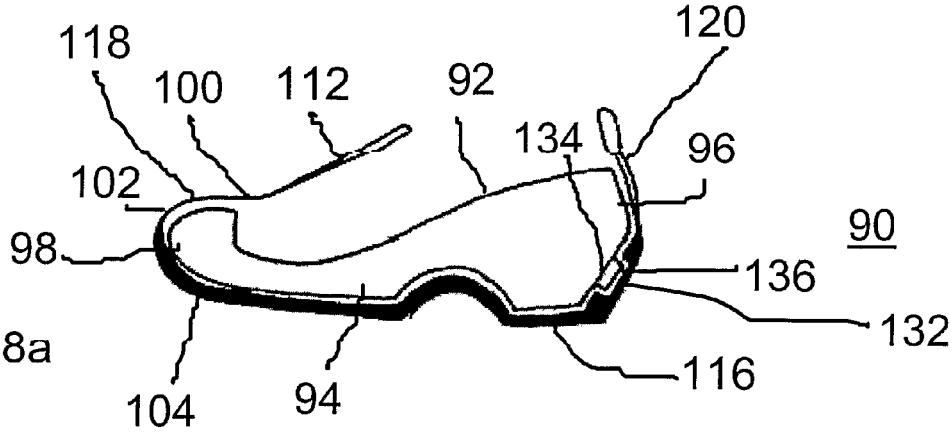
FIG. 8*a* is a sectional view of a modular shoe system that is constructed and operable in accordance with a first alternate embodiment of the present invention.
Figure 8B:
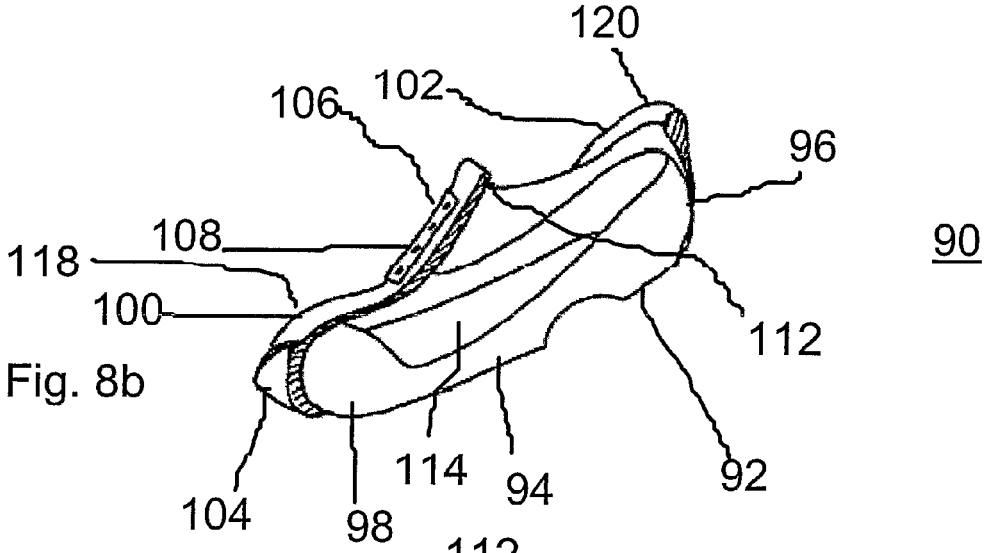
FIG. 8*b* is a partial view of a modular show system of FIG. 8*a* having a section of the removable cover cut away.
Figure 8C:
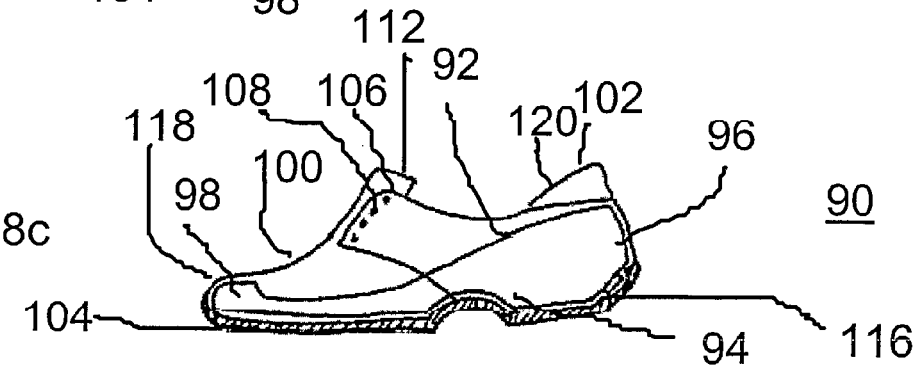
FIG. 8*c* is a schematic view of the modular shoe system of FIG. 8*a;*

Reference is now made to FIGS. 8*a* to 8*c*. FIG. 8*a* is a sectional view of a modular shoe system 90 that is constructed and operable in accordance with a first alternate embodiment of the present invention. FIG. 8*b* is a partial view of shoe system 90 of FIG. 8*a* having a section of a removable cover 100 cut away. FIG. 8*c* is a schematic view of shoe system 90 of FIG. 8*a* (for the sake of clarity and presentation, certain features which would otherwise be hidden are shown thereby rendering other features semi-transparent). Shoe system 90 includes an internal support structure 92. Internal support structure 92 includes a midsole 94, a heel counter 96 and toe box 98. Shoe system 90 also includes one-piece removable cover 100. Removable cover 100 includes an upper 102 and an outsole 104. Removable cover 100 is configured for being "simply removably attached" to internal support structure 92 substantially solely by pressure exerted by internal 15 support structure 92 on removable cover 100. Internal support structure 92 is inserted into removable cover 100 by first inserting toe box 98 into removable cover 100 and then pushing heel counter 96 into removable cover 100. When shoe system 90 is assembled, a toe portion 118 of upper 102 substantially covers toe box 98 and a rear portion 120 of upper 102 covers heel counter 96. As discussed above, the rear portion 120 includes a flap which partially covers the heal counter substantially along the upper portion of the heal counter 16. The term "simply removably attached" is defined herein as, removable cover 100 does not need to be assembled around internal support structure 92 in order for removable cover 100 to cover internal support structure 92. By way of a non-limiting example, removable cover 100 does not need to be zipped up or buttoned together in order for removable cover 100 to cover internal support structure 92. It should be noted that removable cover 100 may require to be bent in order to insert internal support structure 92 into removable cover 100. The term "attached substantially solely by pressure" is defined herein as, the pressure exerted by internal support structure 92 on removable cover 100 is sufficient to ensure that removable cover 100 remains attached to internal support structure 92 during normal use of shoe system 90 even though, for example, other connection means between removable cover 100 and another element of shoe system 90 strengthens the attachment between removable cover 100 and internal support structure 92. Fastening arrangement 106 includes plurality of eyelets 108 configured for inserting a shoelace (not shown) through eyelets 108. It will be appreciated by those ordinarily skilled in the art that fastening arrangement 106 can be implemented in other forms, for example, but not limited to a stretchable band and a buckle. Removable cover 100 also includes a tongue 112 disposed at least partially beneath fastening arrangement 106. Outsole 104 of removable cover 100 also includes a heel 116. Shoe system 90 also includes an insole 114 disposed in internal support structure 92. Reference is now made to FIG. 8*a*. Shoe system 90 generally includes complementary inter-engaging features 132 for retaining removable cover 100 in position on internal support structure 92. In accordance with the preferred embodiment of the present invention, inter-engaging features 132 has a pin 134 and an indent 136. Pin 134 is disposed on internal support structure 92 and indent 136 is disposed in removable cover 100. It will be appreciated by those ordinarily skilled in the art that indent 136 can be disposed in internal support structure 92 and pin 134 can be disposed on removable cover 100. As described above, removable cover 100 is attached to internal support structure 92 solely by pressure exerted by internal support structure 92 on removable cover 100. Inter-engaging features 132 aid the wearer of shoe system 90 to correctly position removable cover 100 on internal support structure 92. Additionally, inter-engaging features 132 provide additional security to the wearer of shoe system 90 who may be worried about removable cover 100 slipping against internal support structure 92.

It will be appreciated by those ordinarily skilled in the art that the shape of removable cover 100, in particular the shape of the toe section of removable cover 100 can be defined using filler sections inside removable cover 100, the filler sections filling the gap between toe box 98 and removable cover 100. It will be appreciated by those ordinarily skilled in the art that although toe box 98 has been shown as having a generally rounded shape, toe box 98 can be other shapes for example, but not limited to a flat end and a pointed end.

The removable cover 100 preferably includes two main components, an upper and an outsole. The upper is preferably made of commonly used shoe materials such as leather, textile, manmade synthetic, laminate, coagulate, nonwoven, and patent leather. The upper is advantageously adapted to appear as a common shoe exterior. However, the internal construction of the upper does not include the common counter, stiff base (usually made of leather, nonwoven, or bonded fibers), toe-cap stiffeners. Rather the cover is constructed by an economic and efficient method similar to those employed to produce gloves and other soft clothing items. Accordingly, by this efficient and economic method a designer has available numerous possibilities and alternatives. The outsole is preferably made of a variety of sole materials such as synthetics or naturals such as leather, synthetics, thermoplastics, rubbers, latex, wood, corks or combinations of the above. The outsole tread, form and aspect are at designers discretion and may vary according to fashion, style, and functionality of the intended final use of for the modular shoe. The outsole is preferably attached to the upper by either gluing, stitching, direct injection, direct casting, or direct vulcanizing.

Figure 9A:
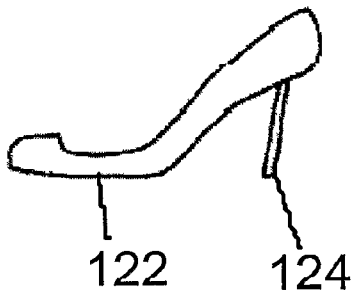
FIG. 9*a* is a side view of an internal support structure having an elongated element disposed thereon that is constructed and operable in accordance with a first alternate embodiment of the present invention.
Figure 9B:
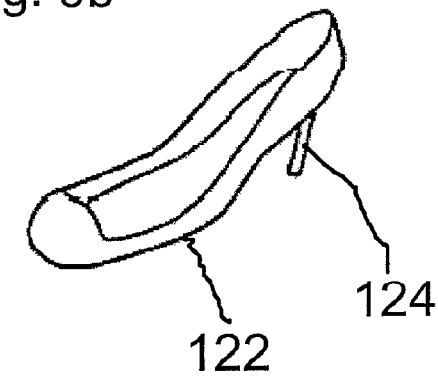
FIG. 9*b* is an isometric view of the internal support structure of FIG. 9*a;*
Figure 9C:
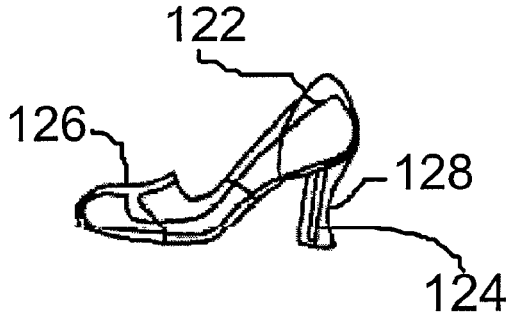
FIG. 9*c* is a schematic view of the internal support structure of FIG. 9*a* inserted into a removable cover.

Reference is now made to FIGS. 9*a* to 9*c*. FIG. 9*a* is a side view of an internal support structure 122 having an elongated element 124 disposed thereon that is constructed and operable in accordance with a first alternate embodiment of the present invention. FIG. 9*b* is an isometric view of internal support structure 122 of FIG. 9*a*. FIG. 9*c* is a schematic view of internal support structure 122 of FIG. 9*a* inserted into a removable cover 126 (for the sake of clarity and presentation, certain features which would otherwise be hidden are shown making other features semi-transparent). Elongated element 124 is configured for insertion into a heel 128 of removable cover 126. Elongated element 124 reduces both rotation and sideways movement of removable cover 126 with respect to internal support structure 122. Additionally, elongated element 124 aids positioning of removable cover 126 on internal support structure 122 as well as preventing any wobbling of heel 128.

Figure 9D:
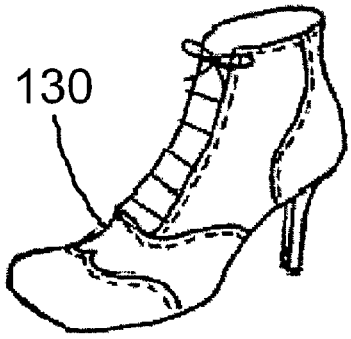
FIGS. 9*d* to 9*f* are isometric views of assembled shoes using the internal support structure of FIG. 9*a*.
Figure 9E:
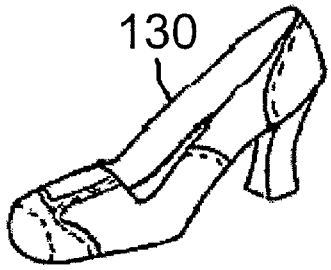
Figure 9F:
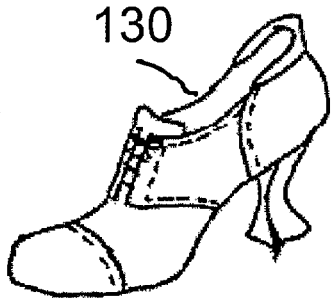

Reference is now made to FIGS. 9*d* to 9*f* are isometric views of assembled shoes 130 using internal support structure 122 of FIG. 9*a*.

It will be appreciated by persons skilled in the art that the present invention is not limited to what has been particularly shown and described hereinabove. Rather, the scope of the present invention includes both combinations and sub-combinations of the various features described hereinabove, as well as variations and modifications thereof that are not in the prior art which would occur to persons skilled in the art upon reading the foregoing description.

The invention claimed is:

1. A modular shoe, comprising:

an internal support structure, the internal support structure comprising an insole having at least a vertical heel support portion and a toe box, the internal support structure having a longitudinal axis running substantially from said heel support portion to the toe box; and a removable cover, the removable cover comprising an outsole and a top cover portion, the removable cover having a longitudinal axis running substantially from a heel portion to a toe portion, the removable cover configured to removably couple to the internal support structure when the internal support structure is positioned within the removable cover, said coupling being by application of pressure by a wearer to the insole of the internal support structure to attach at least the heel support portion and the toe box of the internal support structure to a corresponding area of an inner surface of the removable cover, the top cover portion including a fastening element for removably coupling the cover to a user's foot, the top cover portion further including a flap for partially covering a top portion of said internal support structure vertical heel support portion so as to align the longitudinal axis of the internal support structure and the longitudinal axis of the removable cover.

2. The modular shoe in accordance with claim 1, wherein the internal support structure further comprises an elongated element extending from an outer surface of the heel support portion, and wherein the removable cover further comprises an receptacle in an inner surface of the heel portion, the receptacle to receive the elongated element to reduce rotation and sideways movement of the removable cover relative to the internal support structure.

* * * * *